US007320427B2

(12) United States Patent
Prestwich

(10) Patent No.: US 7,320,427 B2
(45) Date of Patent: Jan. 22, 2008

(54) MAILBOX

(76) Inventor: Matthew C. Prestwich, 6163 S. 700 W., Murray, UT (US) 84123

( * ) Notice: Subject to any disclaimer, the term of this patent is extended or adjusted under 35 U.S.C. 154(b) by 0 days.

(21) Appl. No.: 11/552,617

(22) Filed: Oct. 25, 2006

(65) Prior Publication Data

US 2007/0210145 A1 Sep. 13, 2007

Related U.S. Application Data

(60) Provisional application No. 60/596,912, filed on Oct. 28, 2005.

(51) Int. Cl.
*B65G 11/04* (2006.01)

(52) U.S. Cl. ..... 232/51; 232/49; 232/45

(58) Field of Classification Search ..... 232/17, 232/45, 47–52

See application file for complete search history.

(56) References Cited

U.S. PATENT DOCUMENTS

| | | | | |
|---|---|---|---|---|
| 5,137,212 | A * | 8/1992 | Fiterman et al. | 232/43.2 |
| 5,400,960 | A * | 3/1995 | Jeffs | 232/43.1 |
| 6,719,195 | B2 * | 4/2004 | Farentinos | 232/45 |
| 6,976,620 | B2 * | 12/2005 | Swider | 232/45 |

* cited by examiner

*Primary Examiner*—William L. Miller
(74) *Attorney, Agent, or Firm*—Geoffrey E. Dobbin

(57) ABSTRACT

The present invention is a security mailbox utilizing a combination package rest and security panel. A mail slot in the security panel prevents easy access to contents of the mailbox. The present invention may be utilized in situations other than mail delivery where security for contents is desired.

8 Claims, 4 Drawing Sheets

MAILBOX

CROSS-REFERENCES TO OTHER PATENT APPLICATIONS

This Application claims priority based on prior filed provisional Application 60/596,912, filed Oct. 28, 2005 and incorporates the same by reference.

FIELD OF THE INVENTION

The present invention relates to the field of mailboxes and more particularly relates to the field of security mailboxes.

BACKGROUND OF THE INVENTION

Mailboxes present a paradoxical problem. The purpose of the mailbox is to place mail, be it envelopes or packages, into the box until the recipient may gather it. However, mail theft has been occurring at an alarming rate recently, as identity theft is becoming one of the most talked about, and practiced, crimes. Therefore, a security mailbox is regularly seen as a more desirable mailbox. However, there is a draw back as security mailboxes tend to hinder the deposit of mail, particularly when both packages and envelopes need to be deposited and as the security features of the mailbox increase. As a result, almost no mailbox can be claimed to be absolutely secure, i.e. a determined thief could not find some way to steal the contents of a mailbox, but all can be claimed to have a deterrence level generated by the increased effort to steal mail. What is therefore needed is a security mailbox that allows for easy deposit of both envelopes and the occasional package while maintaining a discouraging amount of security to protect the mail.

SUMMARY OF THE INVENTION

In view of the foregoing disadvantages inherent in the known types of mailboxes, the present invention provides a dual deposit mailbox for both packages and envelopes. As such, the present invention's general purpose is to provide a new and improved mailbox that is relatively secure and easy to deposit mail parcels and extract the same.

To accomplish these objectives, the mailbox comprises a hollow polyhedral body with two openings. The bottom opening is a standard locked access door allowing the recipient to retrieve mail. The upper door is a pivoting mail receptacle the both serves as a platform to rest packages and a block for access to the interior of the box. Positioned on the platform is a standard mail slot so that the mail carrier may simply deposit envelopes through the slot into the interior of the mailbox. While security is not total, the deterrence factor of a security mailbox is maintained while the ease of depositing mail is greatly enhanced.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the security mailbox is herein described. It should be noted that the articles "a", "an" and "the", as used in this specification, include plural referents unless the content clearly dictates otherwise.

Figure 1:
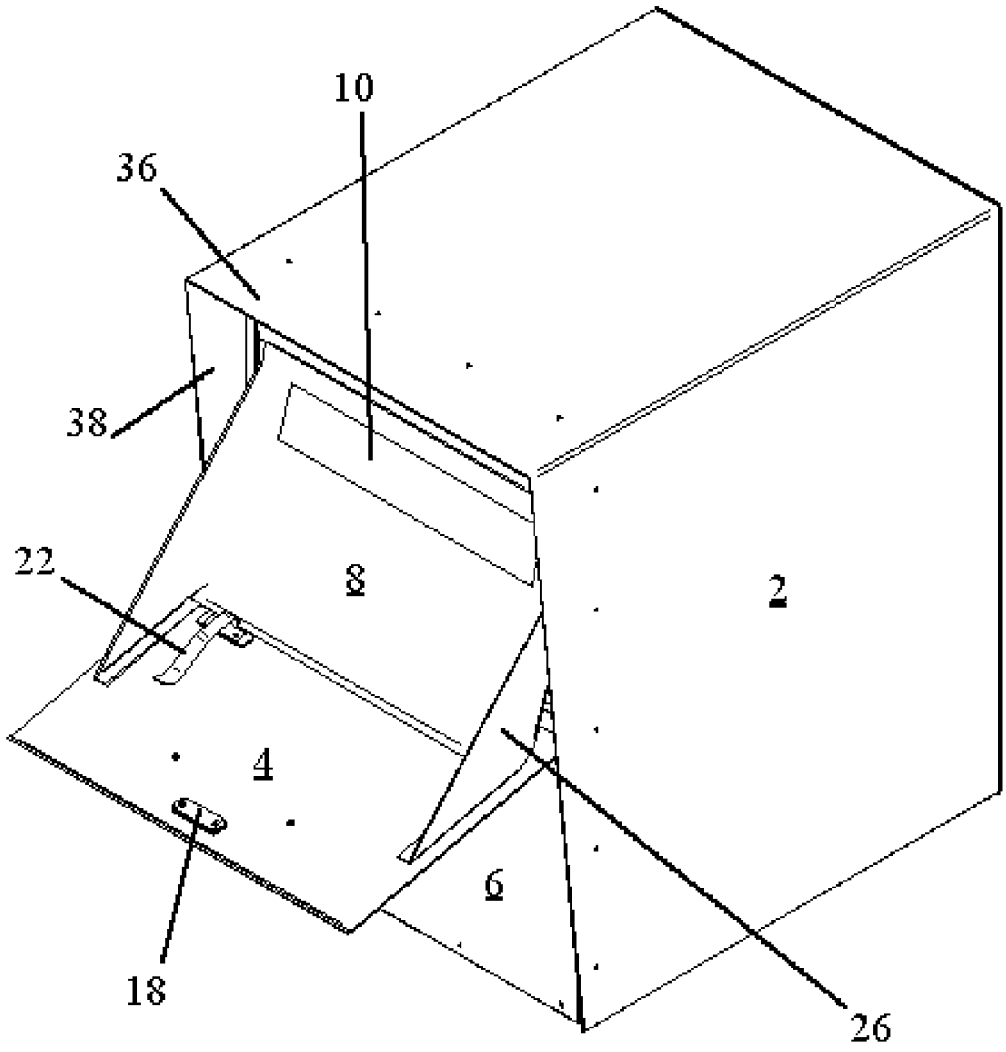
FIG. 1 is a perspective view of the present invention, opened.
Figure 6:
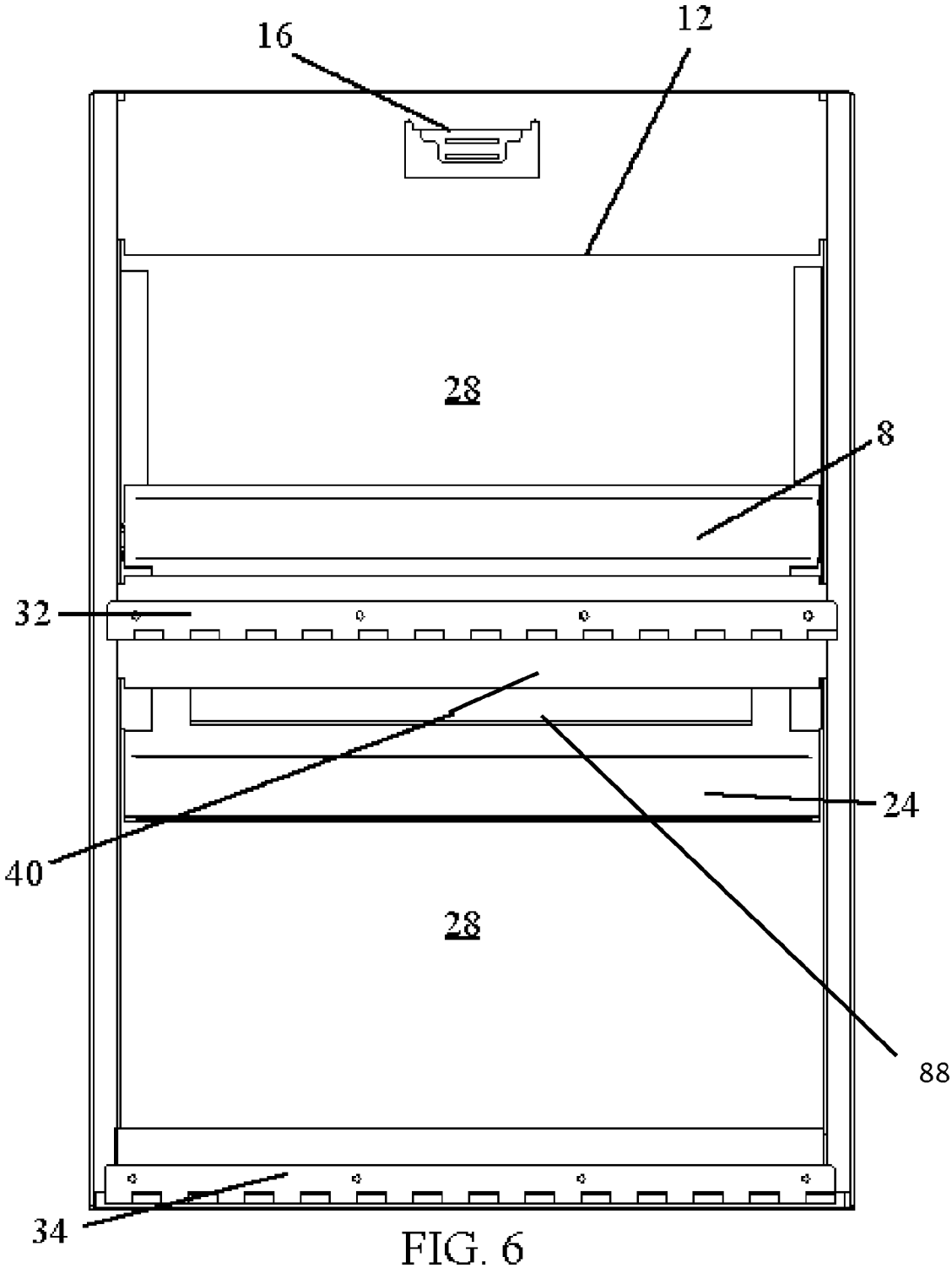
FIG. 6 is a front sectional view of the invention, taken along line 6-6 in FIG. 5.

The preferred embodiment of the invention, as seen in FIG. 1, comprises a generally polyhedral body 2 of standard rectangular configuration and may present weather fins 38, 36 around the front face of the body 2. Two doors are positioned in the front face of the body. Lower door 6 is an access door for the recipient and is locked with locking means 30 interfacing flap 40 (shown in FIG. 6) and allows entry into the interior region 28 of the mailbox, shown in FIG. 3. Lower door 6 is hingedly attached to the body at hinge 34 shown in FIG. 6. Deposit door 4 is hingedly attached to the body at hinge 32 shown in FIG. 6. It is counterweighted by deposit platform 8, which features mail slot 10 and may feature mail fastener 22.

Figure 5:
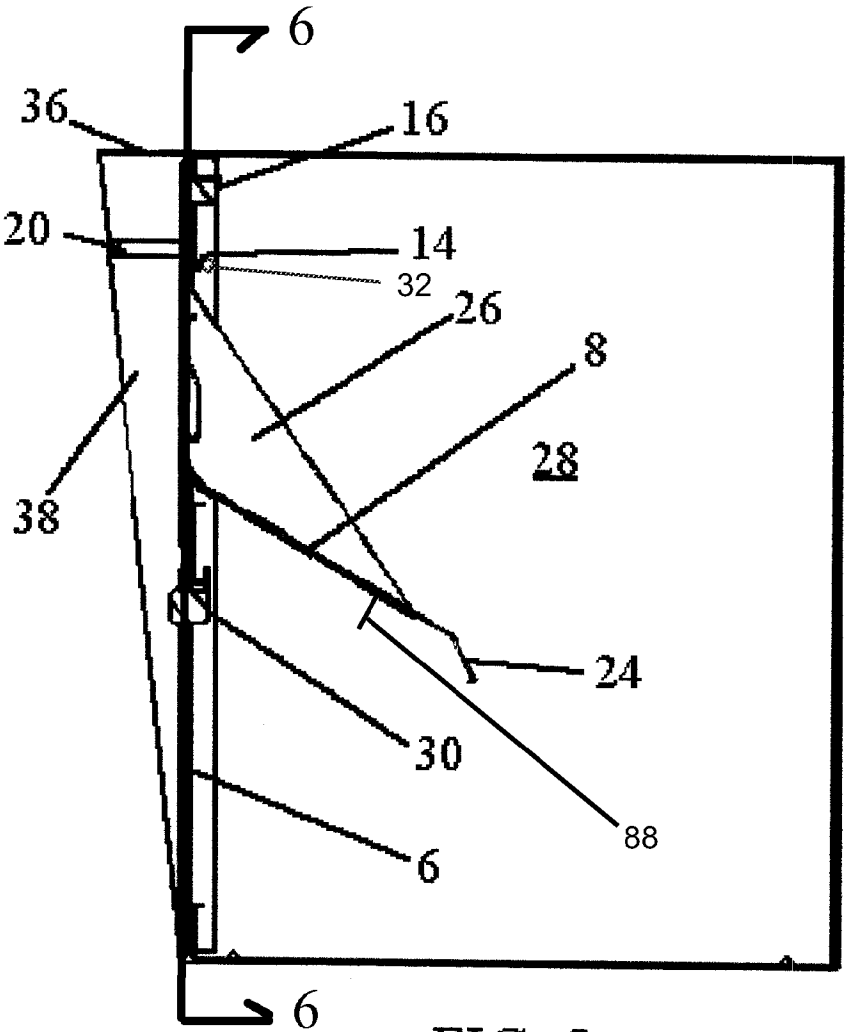
FIG. 5 is a sectional view of the invention, taken along line 5-5 in FIG. 4.
Figure 4:
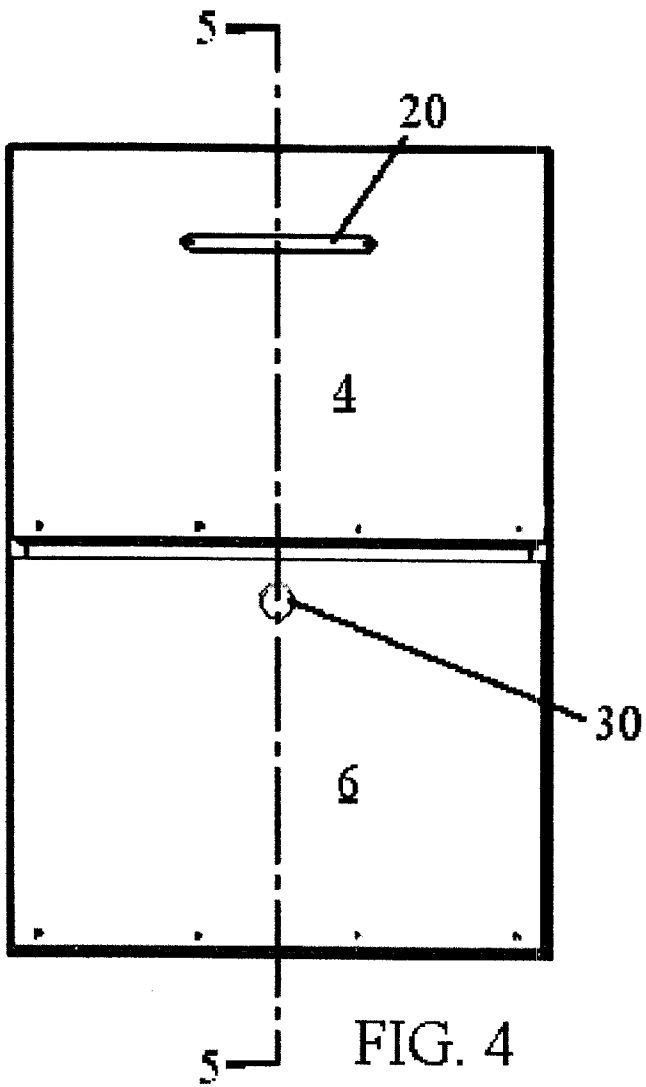
FIG. 4 is a front plan view of the invention, closed.

In operation, the mailbox rests in a closed position, shown in FIGS. 4 and 5. Deposit door 4 is in a vertical position, resting against stop 14 and held in place by a magnetic plate 18 and latch 16 system. Deposit platform is held at approximately a 120-degree angle to deposit door 4 in the interior of the mailbox 28. The extreme end of deposit platform 24 is bent at a more severe angle and the deposit platform 8 is further secured to the deposit door by containment fins 26 which also provide lateral coverage of the interior of the mailbox.

Figure 3:
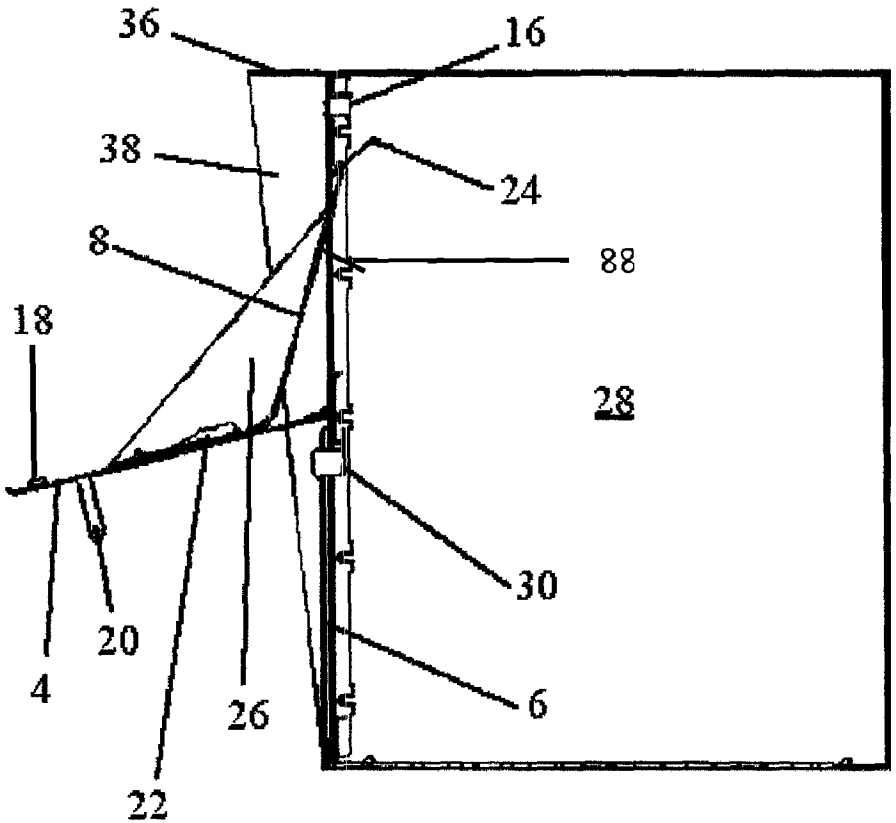
FIG. 3 is a sectional view of the invention, taken along line 3-3 in FIG. 2.
Figure 2:
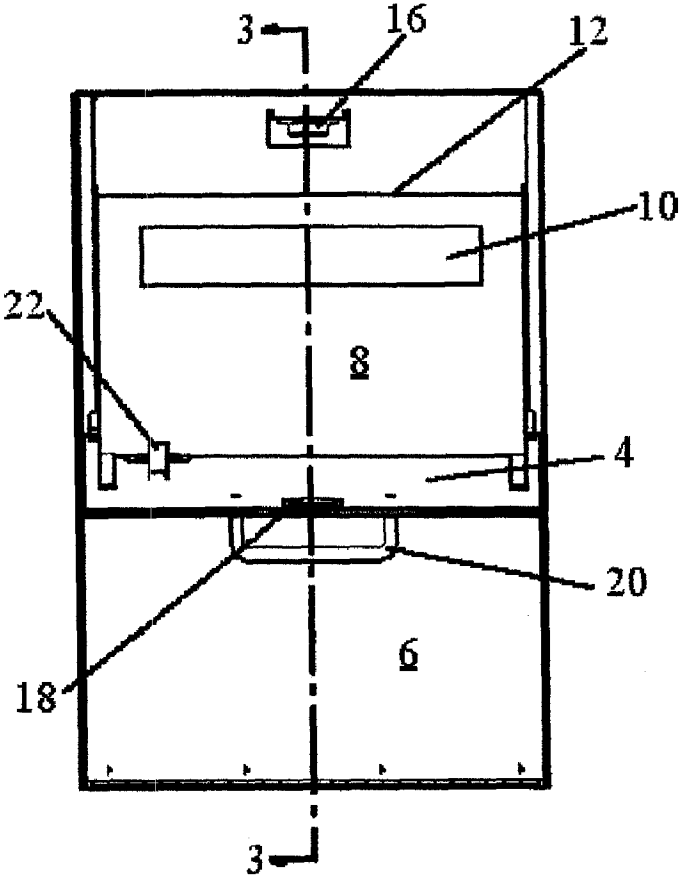
FIG. 2 is a front plan view of the invention, opened.

When handle 20 is pulled, shown in FIGS. 2 and 3, magnetic latch 16 disengages from plate 18 and deposit door 4 is lowered until it is stopped by the extreme end of deposit platform 24 abutting stop 14, thereby sealing the interior 28 from outside access. A cushioning means, such as rubber strip 42 located on stop 14, is ideally provided to increase the sealing factor against elements and to diminish noise and clatter from opening the deposit door 4. The angle of deposit platform 8 and its extreme edge 24 inhibit access while the door is being opened. Mail slot 10 is provided to allow mail envelopes to be deposited through the deposit platform 8 into the interior 28. Ideally, mail slot 8 is made by partially cutting out and bending flap 88 to a right angle behind deposit platform 8. Flap 88 then provides a limiting baffle to further deter would be thieves. Deposit door 4 and platform 8 join together to form a package holding baffle, which merely dumps its contents into the interior 28 when deposit door 4 is closed.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A security mailbox comprising:

a. a polyhedral body defining an interior;

b. a lockable, lower access door through which a user may access the interior region;

c. an upper delivery portal with an at least partial interior rim forming a stop along an upper edge of said portal;

d. a delivery door hingedly attached to the upper delivery portal, said door further comprising a package platform and a security baffle joined at a common edge and an envelope access port positioned within the security baffle, said common edge being proximate the location of hinged attachment of the delivery door upon the portal, the envelope access port being comprised of a flap cut out of the security baffle and bent into the interior of the mailbox, as defined when the delivery door is open, at approximately a 90° angle relative to the security baffle;

e. means of securing the delivery door in a closed position and means of opening the delivery door;

wherein, the security baffle is suspended in the interior of the mailbox when the delivery door is in a closed position and abuts the polyhedral body at the rim around the upper delivery portal when the delivery door is open.

2. The security mail box of claim 1, the delivery door further comprising two containment fins, one on either side of the door, extending between the package platform and the security baffle.

3. The security mail box of claim 2, the security baffle having an extreme edge which is bent toward the interior of the mail box at an obtuse angle relative to the rest of the security baffle.

4. The security mailbox of claim 3, further comprising a rubberized strip of material located along the rim of the upper delivery portal.

5. The security mail box of claim 4, an angle between the package platform and security baffle being approximately 120°.

6. The security mail box of claim 1, the security baffle having an extreme edge which is bent toward the interior of the mail box at an obtuse angle relative to the rest of the security baffle.

7. The security mailbox of claim 1, further comprising a rubberized strip of material located along the rim of the upper delivery portal.

8. The security mail box of claim 1, an angle between the package platform and security baffle being approximately 120°.

* * * * *